US006637563B1

(12) United States Patent
Ruckh

(10) Patent No.: US 6,637,563 B1
(45) Date of Patent: Oct. 28, 2003

(54) CLEAR PLASTIC CASE FOR MOVING THROUGH AN AIRPORT

(76) Inventor: Donald W. Ruckh, 11532 Forest La. Ave., Pickerington, OH (US) 42147

( * ) Notice: Subject to any disclaimer, the term of this patent is extended or adjusted under 35 U.S.C. 154(b) by 0 days.

(21) Appl. No.: 10/192,586

(22) Filed: Jul. 11, 2002

(51) Int. Cl.[7] ..... A45C 3/00; A45C 13/26

(52) U.S. Cl. ..... 190/108; 190/102; 190/110; 383/106; 150/111

(58) Field of Search ..... 190/102, 108, 190/110; 383/106; 150/111, 145

(56) References Cited

U.S. PATENT DOCUMENTS

| | | | | | |
|---|---|---|---|---|---|
| 2,707,035 | A | * | 4/1955 | Lashley | 190/108 |
| 3,351,064 | A | * | 11/1967 | Dohn | 383/106 |
| 3,370,629 | A | * | 2/1968 | Neuman | 383/106 X |
| 3,741,355 | A | | 6/1973 | Slan | 190/109 |
| 3,807,537 | A | | 4/1974 | O'Reilly | 190/109 |
| 3,870,132 | A | * | 3/1975 | Hanley | 383/106 X |
| 4,524,867 | A | | 6/1985 | Klein et al. | 206/232 |
| 4,580,667 | A | * | 4/1986 | Herwood | 190/108 X |
| 4,669,587 | A | | 6/1987 | Zitt | 190/109 |
| 4,685,570 | A | * | 8/1987 | Medow | 383/106 X |
| 4,716,947 | A | | 1/1988 | Haddock | 150/106 |
| 4,913,283 | A | | 4/1990 | Stuhn | 206/224 |
| 5,149,202 | A | | 9/1992 | Dickert | 383/106 |
| 5,255,833 | A | * | 10/1993 | McAllister | 150/110 X |
| 5,354,131 | A | * | 10/1994 | Mogil | 190/108 X |
| 5,862,526 | A | * | 1/1999 | Longcor et al. | 2/238 |
| 6,000,509 | A | * | 12/1999 | Chisholm | 190/109 |
| 6,012,557 | A | * | 1/2000 | Derelanko | 190/108 |
| 2001/0054569 | A1 | | 12/2001 | Bisbal et al. | 206/756 |

FOREIGN PATENT DOCUMENTS

| | | | |
|---|---|---|---|
| EP | 702911 | * | 3/1996 |
| FR | 2535955 | * | 5/1984 |
| WO | WO 96/32860 | | 10/1996 |
| WO | WO 99/06292 | | 2/1999 |

* cited by examiner

*Primary Examiner*—Sue A. Weaver
(74) *Attorney, Agent, or Firm*—Richard C. Litman

(57) ABSTRACT

A clear plastic case which can be attached to carry-on luggage to secure items such as a personal lap-top computer and personal items such as keys, change, phone, etc. It is clear plastic on both top and bottom so that everything in the case is visible to airport security. It has a plurality of pockets with closures which are readily openable. The case can hold all metal items that a person normally carries in clothing pockets so that there is a reduction in time at the security screening gate, as a user may empty their pockets before approach to the gate, and may recovers their belongings a distance from the gate after screening.

12 Claims, 3 Drawing Sheets

CLEAR PLASTIC CASE FOR MOVING THROUGH AN AIRPORT

BACKGROUND OF THE INVENTION

1. Field of the Invention

The present invention relates to cases and, more particularly, to a case with a foldable and collapsible transparent series of holding pockets for personal items made of metal, that would otherwise cause security screening at airports to become activated, yet allow confidence that a user's personal items will clear airport and other security screenings.

2. Description of the Related Art

There are a wide variety of carrying containers that have al portion that is see-through or transparent. There are none that are completely transparent, flexible and collapsible with several segments or pockets that have their own closure.

U.S. Pat. No. 4,716,947 to Haddock for an "All Weather Soft-Sided Carrier System" is all transparent but lacks pockets with accessible closures.

U.S. Pat. No. 5,149,202 to Dickert for a "Container Structure Having Transparent Outer Pouch" has a transparent outer pocket attached to a carrying structure but lacks closable seal.

U.S. Pat. No. 2001/0054569 to Bisbal et al. for a "Product Ensemble Display and Carrying Package" is only partly transparent and lacks pockets with their own seals.

U.S. Pat. No. 3,741,355 to Slan for a "Soft Sided Luggage Case", U.S. Pat. No. 3,807,537 to O'Reilly for an "Attache Case With Transparent Side Walls", U.S. Pat. No. 4,524,867 to Klein et al. for a "Case for Accommodating Written Material for Presentation Purposes", U.S. Pat. No. 4,669,587 to Zitt for a "Portable Receptacle", U.S. Pat. No. 4,913,283 to Stuhn for a "Case for Drawing Boards", PCT/US WO 96/32860 to Smith et al. for a "Soft Stowage System" and PCT/AU WO 99/06292 to Karpisek for "Inspection Side Panel for a Container" all feature a panel of transparent material in combination with other non-transparent portions.

None of the above inventions and patents, taken either singularly or in combination, is seen to describe the instant, invention as claimed. Thus a clear plastic case for moving through an airport solving the aforementioned problems is desired.

SUMMARY OF THE INVENTION

The invention is a clear plastic case attached to carry-on luggage, which can house not only a personal lap-top computer but also personal items such as keys, change, phone, etc. It is clear plastic on both top and bottom so that everything in the case is visible to airport security. There are a plurality of pockets with closures so that a user may feel a bit more secure about placement of his/her articles on a conveyor for screening. The closures are readily openable so that if asked to prove that items are actual working devices, such requests are easily followed without undue delays. The case is intended to hold all metal items that a person normally carries in clothing pockets so that there is a reduction in time at the security screening gate as a user may empty their pockets before approach to the gate and may be recovered a distance from the gate after screening.

Accordingly, it is a principal object of the invention to provide a case device to readily display to security personnel those metallic items which would activate a metal sensor.

It is another object of the invention to be able to access all items on display readily to prove that the item is what it appears to be.

It is a further object of the invention to keep a user's personal belongings secure and together when going through a security search.

Still another object of the invention is to allow a user to collect his or her metallic items from his or her pockets for display in a more remote and private area than in front of security or those other travelers that also need to pass trough the security screening.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is an assembly to aid a user in moving through airport security. Though it may be used by itself, it will normally be attached to another item of carry-on baggage and proceed through the security conveyor. In this way, a user's personal pocket carried items will still be together, will not be shifted about, and will be made accessible to others at the security checkpoint. For example, as it is important to prove that electronic items are what they appear to be, each of the pockets of the case has its own seal so that each pocket may be opened to access the items inside, individually. As the case is flexible and foldable, it may be folded until display so that a user may place his or her pocket items inside the clear case pockets before they get to the checkpoint and feel confident that they can proceed through the checkpoint, and then recover their pocket carried items away from the checkpoint and away from prying eyes of their fellow passengers.

Figure 1:
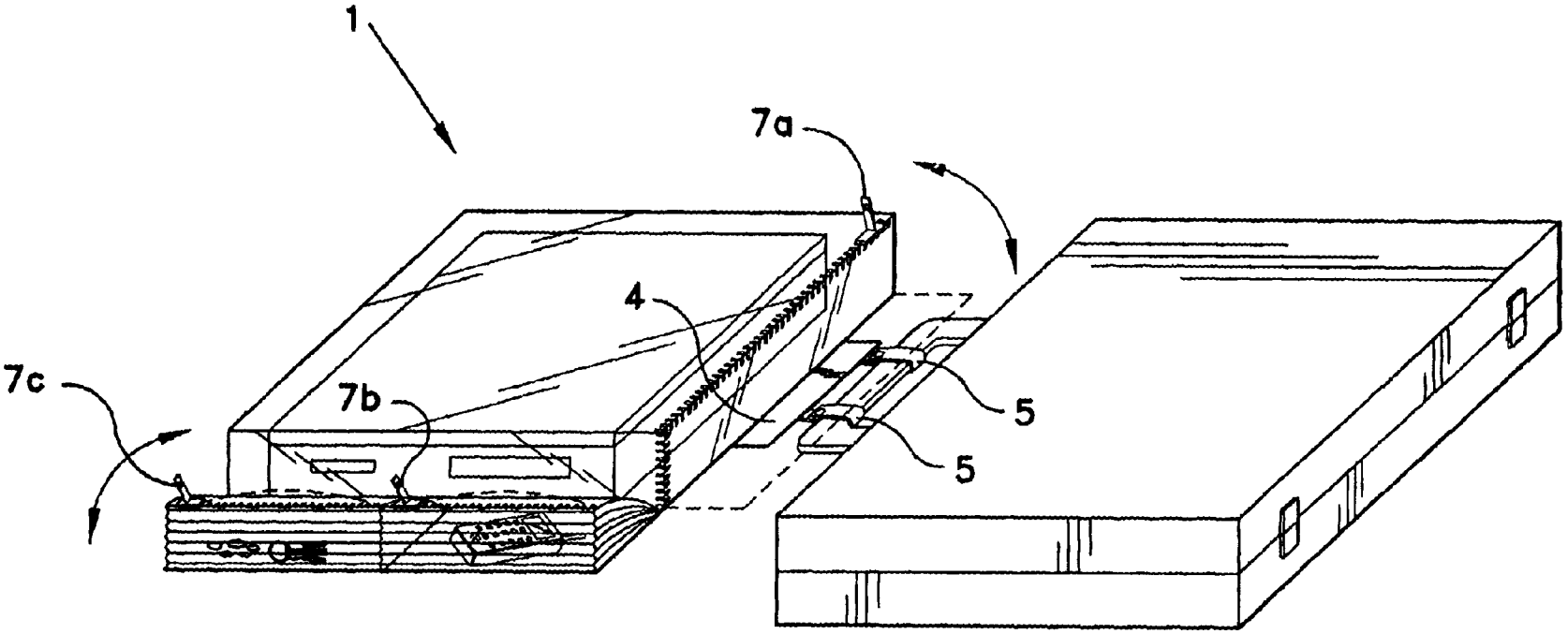
FIG. 1 is a perspective view of a clear plastic case moving through an airport conveyor, and attached to a personal computer, carrying case, according to the present invention.
Figure 2:
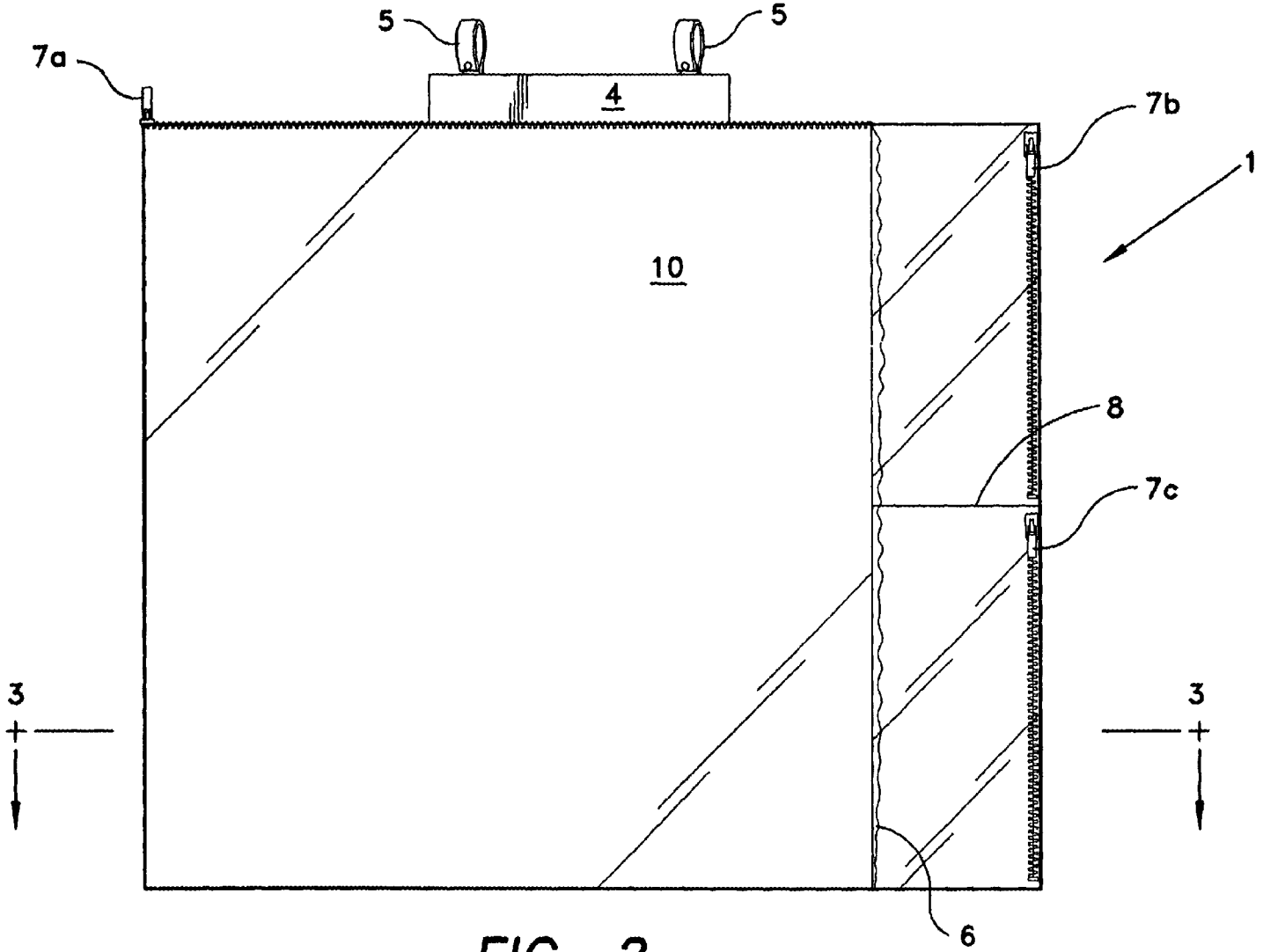
FIG. 2 is a top plan view of the invention.
Figure 3:
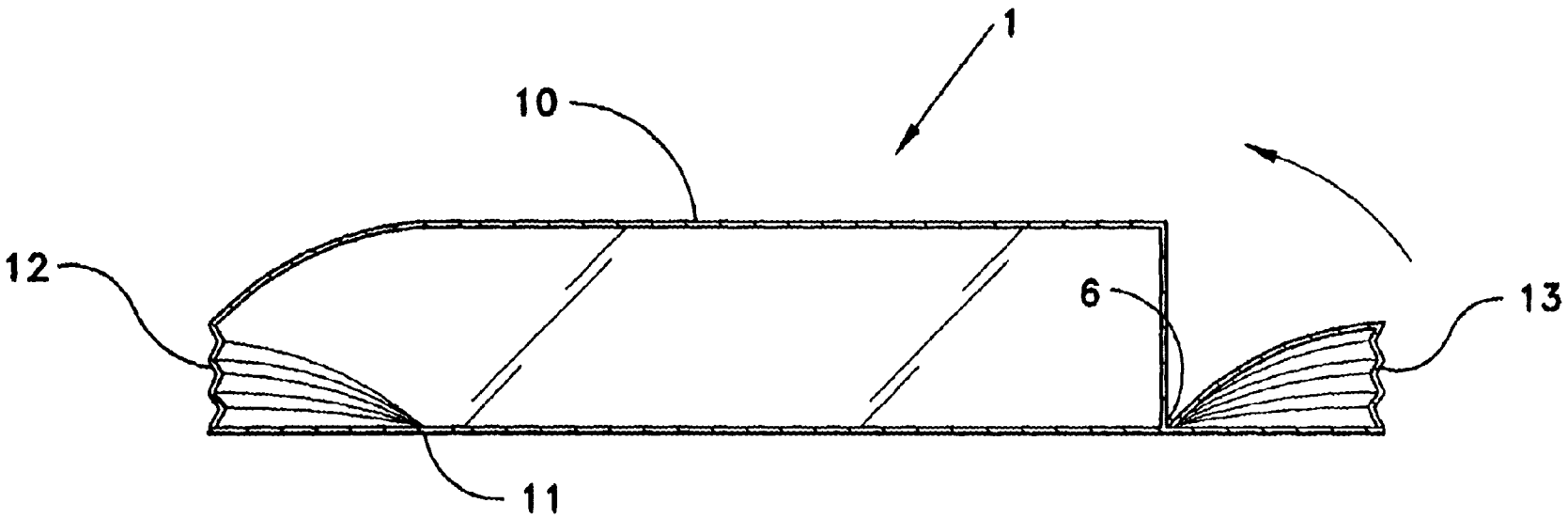
FIG. 3 is a section view taken along lines 3—3 of FIG. 2.

The clear case 1 is constructed of plastic that is flexible and durable but not rigid and breakable. It may be made of any of the polyurethanes or polyethelenes or other plastics that are both flexible and transparent. The clear case 1 has a transparent back 11 (FIG. 3) to which transparent face 10 is attached at the edges. Face 10 and back 11 may be welded or adhered, not shown, according to the most effective procedures appropriate for the materials used.

Accordion folds 12 and 13 provide for flexibility at the sides and face 10 is welded to back 11 at weld 6 and weld 8 to form individual pockets. It is understood that welds 6 and 8 may be heat c sonic welds according to the type of plastic used. It should also be considered that the face and back may be adhered together (not shown).

As it can be important that the clear case be attached to another carry-on item, clear case 1 has an attachment flap 4 that may be attached to the inside of a personal computer case by use of safety pins or other members. Attached to flap 4 are loops 5 which may be used to attach to the handle of the carry-on case if desired. The loops 5 may have any type of closure from a button, pin or hook/loop fasteners to close the loop about the desired anchor.

In order to securely close each pocket, each pocket should have its own closure. Each closure could be hook/loop fabric material or plastic zips as in food protection bags or a plastic zip with tab as is frequently used in clothing protection bags. Shown are zippers 7A, 7B and 7C. In this way items in the pockets may be easily accessed in order to prove to security personnel that the items displayed are fully functioning devices. Each of the zippers are full length so that when opened the pocket is fully available for easy insertion and easy removal of the items.

It is to be understood that the present invention is not limited to the embodiment described above, but encompasses any and all embodiments within the scope of the following claims.

I claim:

1. A clear plastic case for moving through a security checkpoint, comprising:

a rectangular back member formed of a clear, flexible plastic, said back member having a top edge, a bottom edge, and opposing side edges;

a front member formed of a clear, flexible plastic, said front member being attached to the back member to define a volume therebetween;

a plurality of pockets disposed within the volume defined between said front member and said back, each of said pockets defining a separate compartment and having an openable closure assembly to securely close each said compartment; and a flap attached midway along the top edge of said back member, said flap including at least one loop for removably securing the clear plastic case to a handle of a carry-on luggage.

2. The clear plastic case as recited in claim 1, wherein said at least one loop includes a pair of loops, each of said loops having a fastener for removably closing the pair of loops about the handle of the carry-on luggage.

3. The clear plastic case as recited in claim 2, wherein said fastener is selected from the group consisting of a button, a pin and a hoop and loop element.

4. The clear plastic case as recited in claim 1, including a first weld and a second weld forming said plurality of pockets, said first weld extending from the top edge to the bottom edge adjacent one of he side edges, said second weld perpendicularly extending from a point midway of said first weld to said one of the side edges.

5. The clear plastic case as recited in claim 4, wherein each of said pockets include an expandible accordion-fold structure proximate each of the opposing side edges.

6. The clear plastic case as recited in claim 1, wherein each said closure assembly is a zipper.

7. A clear plastic case in combination with an item of carry-on luggage for moving through a security checkpoint, wherein said clear plastic case comprises:

a rectangular back member formed of a clear, flexible plastic, said back member having a top edge, a bottom edge, and opposing side edges;

a front member formed of a clear, flexible plastic, said front member being attached to the back member to define a volume therebetween;

a plurality of pockets disposed within the volume defined between said front member and said back, each of said pockets defining a separate compartment and having an openable closure assembly to securely close each said compartment; and a flap attached midway along the top edge of said back member, said flap including at least one loop attached to a handle of the item of carry-on luggage.

8. The combination as recited in claim 7, wherein said at least one loop includes a pair of loops, each of said loops having a fastener for removably closing the pair of loops about the handle of the carry-on luggage.

9. The combination as recited in claim 8, wherein said fastener is selected from the group consisting of a button, a pin and a hoop and loop element.

10. The combination as recited in claim 7, including a first weld and a second weld forming said plurality of pockets, said first weld extending from the top edge to the bottom edge adjacent one of the side edges, said second weld perpendicularly extending from a point midway of said first weld to said one of the side edges.

11. The combination as recited in claim 10, wherein each of said pockets include an expandible accordion-fold structure proximate each of the opposing side edges.

12. The combination as recited in claim 7, wherein each said closure assembly is a zipper.

* * * * *